US010981380B2

(12) United States Patent
Yoshida

(10) Patent No.: US 10,981,380 B2
(45) Date of Patent: Apr. 20, 2021

(54) LIQUID DISCHARGE HEAD, LIQUID DISCHARGE DEVICE, AND LIQUID DISCHARGE APPARATUS

(71) Applicant: Takahiro Yoshida, Kanagawa (JP)

(72) Inventor: Takahiro Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/728,015

(22) Filed: Dec. 27, 2019

(65) Prior Publication Data

US 2020/0238696 A1 Jul. 30, 2020

(30) Foreign Application Priority Data

Jan. 28, 2019 (JP) ..... JP2019-011852

(51) Int. Cl.
*B41J 2/14* (2006.01)

(52) U.S. Cl.
CPC ..... *B41J 2/14024* (2013.01); *B41J 2/14032* (2013.01); *B41J 2/1433* (2013.01); *B41J 2/14274* (2013.01); *B41J 2002/14362* (2013.01)

(58) Field of Classification Search
CPC ..... B41J 2/14024; B41J 2/14032; B41J 2/14274
See application file for complete search history.

(56) References Cited

U.S. PATENT DOCUMENTS

2006/0061632 A1* 3/2006 Mita ..... B41J 2/14274 347/68
2013/0147887 A1 6/2013 Kimura et al.
2014/0210914 A1 7/2014 Yoshida et al.
2015/0077469 A1 3/2015 Kohda et al.
2015/0246533 A1 9/2015 Nemoto et al.
2015/0246536 A1 9/2015 Yoshida
2015/0375504 A1 12/2015 Kitaoka et al.
2016/0082728 A1 3/2016 Kohda et al.
2016/0096369 A1 4/2016 Shimizu et al.
2016/0129691 A1 5/2016 Yoshida
(Continued)

FOREIGN PATENT DOCUMENTS

JP 2013-144431 7/2013
JP 2017-144659 8/2017

*Primary Examiner* — Lamson D Nguyen
(74) *Attorney, Agent, or Firm* — Oblon, McClelland, Maier & Neustadt, L.L.P.

(57) ABSTRACT

A liquid discharge head includes a plurality of nozzles through which a liquid is discharged, the plurality of nozzles arrayed in a nozzle array direction, a plurality of pressure chambers respectively communicating with the plurality of nozzles, a plurality of individual channels respectively communicating with the plurality of pressure chambers, a common channel communicating with each of the plurality of individual channels, an individual-channel member including the plurality of pressure chambers and the plurality of individual channels, a common-channel member including the common channel, and a partition between the individual-channel member and the common-channel member. The partition includes a plurality of through-hole regions each connecting the common channel and the plurality of individual channels, and a plurality of recoverably-deformable regions facing the common channel.

17 Claims, 15 Drawing Sheets

(56) References Cited

U.S. PATENT DOCUMENTS

| | | | | |
|---|---|---|---|---|
| 2016/0167364 | A1* | 6/2016 | Matsumoto | B41J 2/04588 347/9 |
| 2016/0185113 | A1 | 6/2016 | Yoshida et al. | |
| 2016/0297193 | A1 | 10/2016 | Yoshida | |
| 2017/0087865 | A1 | 3/2017 | Yoshida et al. | |
| 2017/0096015 | A1 | 4/2017 | Odaka et al. | |
| 2017/0120602 | A1 | 5/2017 | Nakai et al. | |
| 2017/0157924 | A1 | 6/2017 | Otome et al. | |
| 2017/0239949 | A1 | 8/2017 | Yoshida | |
| 2017/0253062 | A1 | 9/2017 | Murakami et al. | |
| 2017/0297333 | A1 | 10/2017 | Kohda et al. | |
| 2018/0194135 | A1 | 7/2018 | Iwama et al. | |
| 2018/0257374 | A1 | 9/2018 | Yoshida et al. | |
| 2018/0272709 | A1 | 9/2018 | Iwata et al. | |
| 2018/0272730 | A1 | 9/2018 | Odaka et al. | |
| 2018/0272740 | A1 | 9/2018 | Otome et al. | |
| 2018/0272743 | A1 | 9/2018 | Nakai et al. | |
| 2019/0084313 | A1 | 3/2019 | Kohda et al. | |
| 2019/0224974 | A1* | 7/2019 | Kihira | B41J 2/14233 |
| 2019/0240978 | A1 | 8/2019 | Kawahara et al. | |
| 2019/0263119 | A1 | 8/2019 | Odaka et al. | |

* cited by examiner

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-011852, filed on Jan. 28, 2019 in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head discharges a liquid. Discharge characteristics of the liquid discharge head fluctuate due to residual vibration caused by liquid discharge.

The liquid discharge head includes a frame that forms a common chamber. The frame is divided, and a vibration damping member is interposed between the divided frame to damp a pressure vibration in the common chamber.

SUMMARY

In an aspect of this disclosure, a liquid discharge head is provided that includes a plurality of nozzles through which a liquid is discharged, the plurality of nozzles arrayed in a nozzle array direction, a plurality of pressure chambers respectively communicating with the plurality of nozzles, a plurality of individual channels respectively communicating with the plurality of pressure chambers, a common channel communicating with each of the plurality of individual channels, an individual-channel member including the plurality of pressure chambers and the plurality of individual channels, a common-channel member including the common channel, and a partition between the individual-channel member and the common-channel member. The partition includes a plurality of through-hole regions each connecting the common channel and the plurality of individual channels, and a plurality of recoverably-deformable regions facing the common channel.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
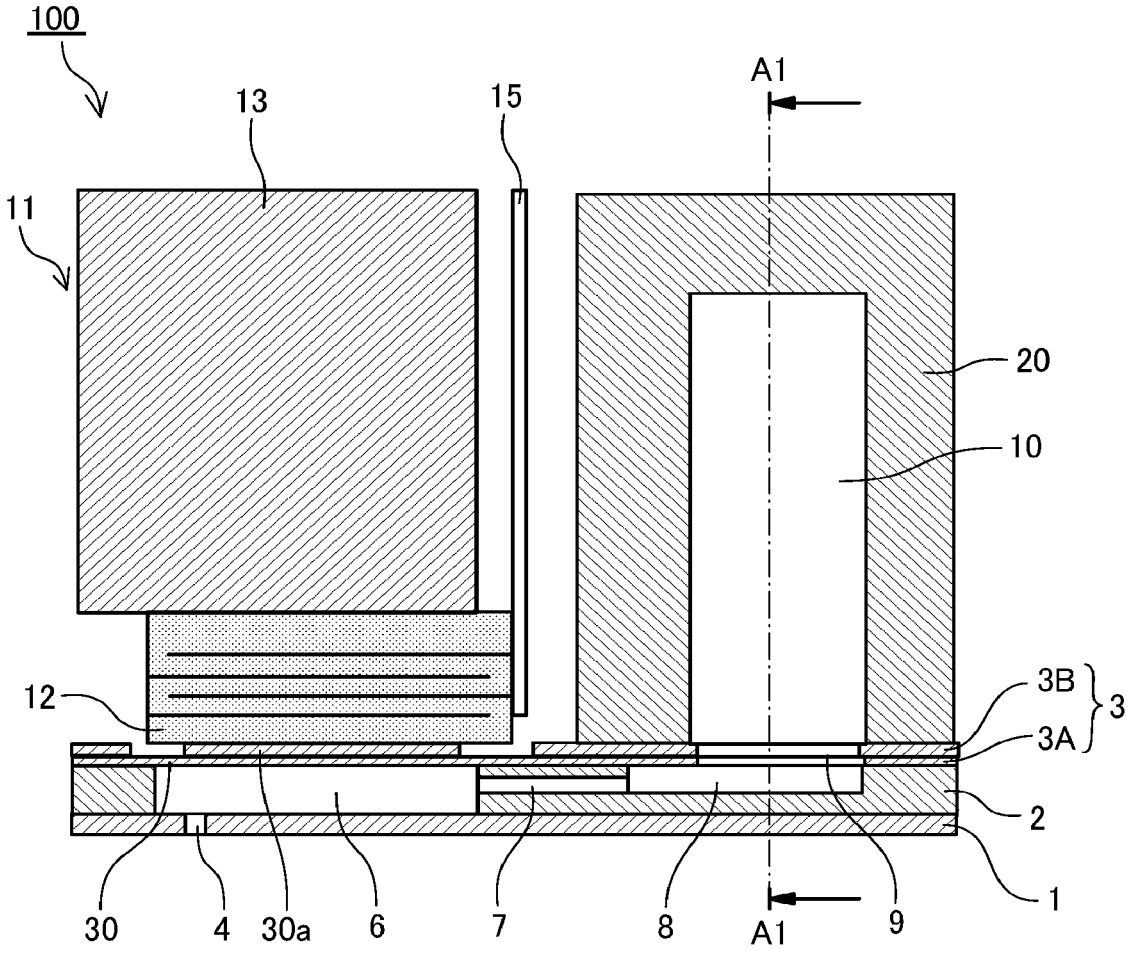
FIG. 1 is a cross-sectional view of a liquid discharge head according to a first embodiment of the present disclosure along a direction perpendicular to a nozzle array direction corresponding to a line B1-B1 in FIG. 3.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Figure 2:
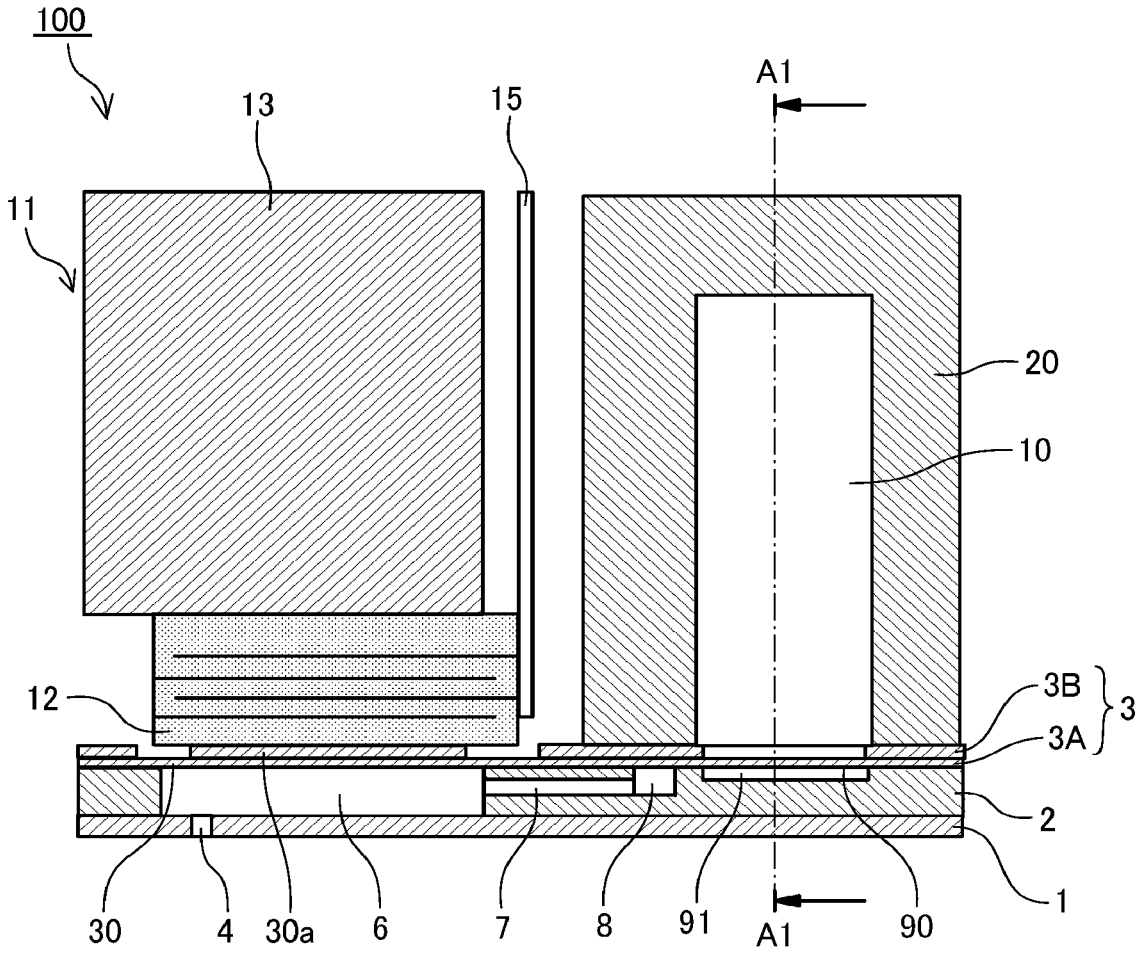
FIG. 2 is a cross-sectional view of the liquid discharge head along the direction perpendicular to the nozzle array direction corresponding to a line C1-C1 in FIG. 3.
Figure 3:
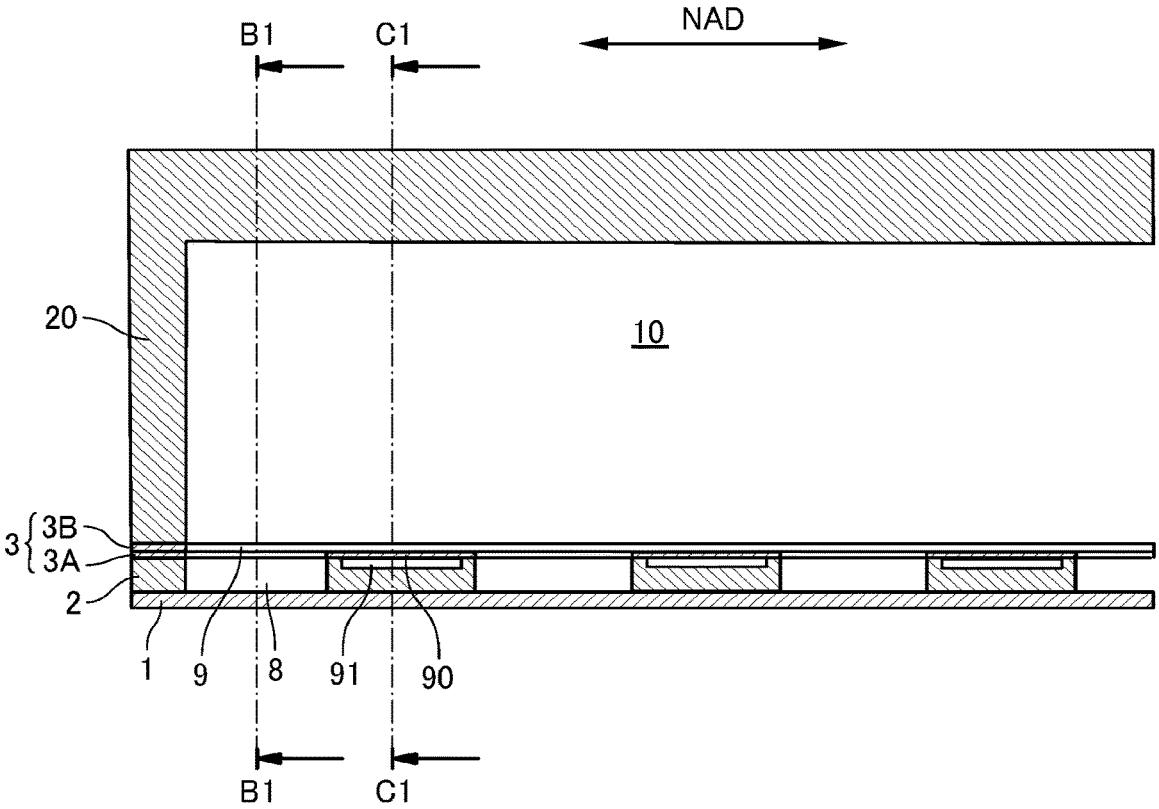
FIG. 3 is a cross-sectional view of the liquid discharge head along the nozzle array direction corresponding to a line A1-A1 in FIGS. 1 and 2.
Figure 4:
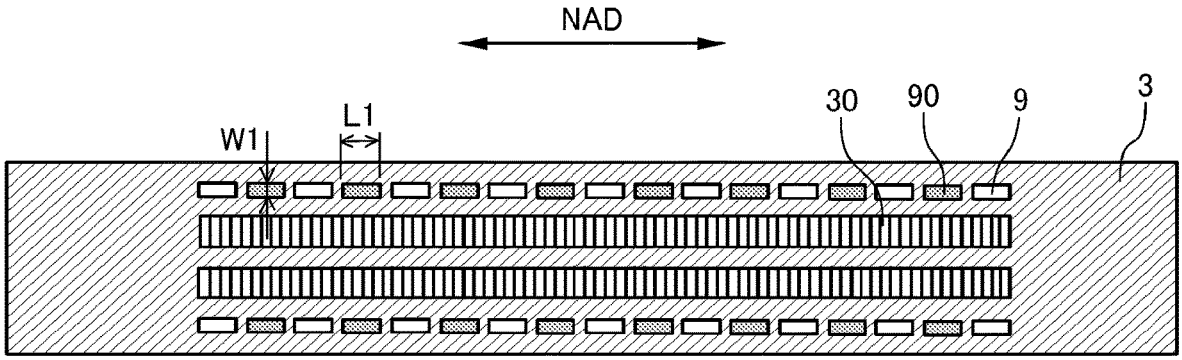
FIG. 4 is a plan view of a diaphragm of the liquid discharge head according to the first embodiment of the present disclosure.

Embodiments of the present disclosure are described below with reference to the attached drawings. A first embodiment of the present disclosure is described with reference to FIGS. 1 to 4. FIG. 1 is a cross-sectional view of a liquid discharge head 100 according to a first embodiment of the present disclosure in a direction perpendicular to a nozzle array direction corresponding to a line B1-B1 in FIG. 3. Hereinafter, the "liquid discharge head" is simply referred to as the "head". The nozzle array direction is indicated by arrow "NAD" in FIG. 3. FIG. 2 is a cross-sectional view of the head 100 in a direction along the nozzle array direction NAD corresponding to a line C1-C1 in FIG. 3. FIG. 3 is a schematic cross-sectional view along the nozzle array direction NAD corresponding to a line A1-A1 in FIGS. 1 and 2. FIG. 4 is a plan view of a diaphragm 3 of the head 100 according to the first embodiment of the present disclosure.

The head 100 according to the first embodiment includes a nozzle plate 1, a channel plate 2 as an individual-channel member, and a diaphragm 3 as a wall that are laminated one on another and bonded to each other. The head 100 further includes a piezoelectric actuator 11 to displace vibration portions 30 of the diaphragm 3 and a common-channel member 20 also serving as a frame of the head 100.

The nozzle plate 1 includes a nozzle array in which a plurality of nozzles 4 to discharge a liquid is arrayed in a nozzle array direction.

The channel plate 2 includes a plurality of pressure chambers 6, a plurality of individual-supply channels 7, and a plurality of intermediate-supply channels 8. The plurality of pressure chambers communicates with the plurality of nozzles 4, respectively. The plurality of individual-supply channels 7 also serves as fluid restrictors communicating with the plurality of pressure chambers 6, respectively. The intermediate-supply channels 8 communicating with two or more of the plurality of individual-supply channel 7.

The diaphragm 3 includes a plurality of deformable vibration portions 30 (vibration plates) constituting walls of pressure chambers 6 of the channel plate 2. The diaphragm 3 has a two-layer structure (not limited), and is composed of a first layer 3A forming a thin portion from the channel plate 2 side and a second layer 3B forming a thick portion thicker than the thin portion (first layer 3A).

The deformable vibration portions 30 are formed in a portion corresponding to the pressure chambers 6 in the first layer 3A serving as the thin portion. The piezoelectric actuator 11 is joined to the convex portion 30*a*, which is a thick portion on the vibration portion 30 of the second layer 3B of the diaphragm 3.

The piezoelectric actuator 11 includes an electromechanical transducer element as driving device (actuator device or pressure generator) to deform the vibration portions 30 of the diaphragm 3. The piezoelectric actuator 11 is disposed at a first side of the diaphragm 3 opposite a second side of the diaphragm 3 facing the pressure chambers 6.

The piezoelectric actuator 11 includes a piezoelectric member bonded on a base 13. The piezoelectric member is groove-processed by half cut dicing so that each piezoelectric member includes a desired number of pillar-shaped piezoelectric elements 12 that are arranged in certain intervals to have a comb shape. The piezoelectric element 12 is joined to the convex portion 30*a*, which is a thick portion formed on the vibration portion 30 of the diaphragm 3.

The piezoelectric element 12 includes piezoelectric layers and internal electrodes alternately laminated on each other. Each internal electrode is drawn out to an end face of the piezoelectric element 12 and connected to an external electrode (end surface electrode), and a flexible wiring member 15 is connected to the external electrode.

The common-channel member 20 defines a common-supply channel 10. The common-supply channel 10 communicates with the intermediate-supply channel 8 via an opening 9 provided in the diaphragm 3. Further, the common-supply channel 10 communicates with the individual-supply channel 7 via the intermediate-supply channel 8.

In the head 100 thus configured, for example, when a voltage lower than a reference potential (intermediate potential) is applied to the piezoelectric element 12, the piezoelectric element 12 contracts. Accordingly, the vibration portion 30 of the diaphragm 3 is pulled and the volume of the pressure chamber 6 increases, thus causing liquid to flow into the pressure chamber 6.

When the voltage applied to the piezoelectric element 12 is raised, the piezoelectric element 12 expands in a direction of lamination of the piezoelectric element 12. The vibration portion 30 of the diaphragm 3 deforms in a direction toward the nozzle 4 and contracts the volume of the pressure chambers 6. As a result, the liquid in the pressure chambers 6 is squeezed out of the nozzle 4.

The drive method of the head 100 is not limited to the above-described method (i.e., pull-push discharging). The way of discharging changes depending on how a drive waveform is applied. For example, pull discharging or push discharging is possible.

Next, the configuration of dampers in the present embodiment is described below with reference to FIGS. 3 and 4.

The diaphragm 3 as a partition is arranged between the channel plate 2 and the common-channel member 20. The channel plate 2 is an individual-channel member that forms the pressure chamber 6 and the individual-supply channel 7. The common-channel member 20 defines the common-supply channel 10.

As illustrated in FIGS. 3 and 4, the diaphragm 3 as a partition includes the opening 9 as a through hole region and the vibration damping region 90 as a recoverably-deformable region facing the common-supply channel 10 are alternately arranged in the nozzle array direction NAD.

The opening 9 communicates the common-supply channel 10 and the intermediate-supply channel 8 that communicates with the individual-supply channel 7. In the present embodiment, the opening 9 is formed by one through hole.

The vibration damping region 90 is formed by the first layer 3A that is a thin portion of the diaphragm 3. That is, the diaphragm 3 serving as a partition includes a first layer 3A that becomes a thin portion and a second layer 3B that becomes a thick portion. A recoverably-deformable region is formed by the first layer 3A that is a thin portion.

As illustrated in FIG. 4, a vibration damping region 90 has a length L1 in the nozzle array direction NAD and a width W1 in a direction perpendicular to the nozzle array direction NAD. The length L1 is larger than the width W1.

A plurality of materials having different rigidities, for example, a laminated member of a resin material and a metal material may be used as the diaphragm 3. Further, the recoverably-deformable region (vibration damping region 90) may be formed of a material having a relatively lower rigidity, for example, a resin material (the same applies to the following embodiments).

Further, the channel plate 2 includes a plurality of gas chambers 91 formed on a surface of the channel plate 2 at positions facing (corresponding to) the vibration damping region 90. Specifically, each of the plurality of gas chambers 91 of the channel plate 2 faces a surface of the vibration damping regions 90 of the diaphragm 3 opposite to a surface of the diaphragm 3 facing the common-supply channel 10. A compliance of each of plurality of vibration damping regions 90 is larger than a compliance of an air layer of each of plurality of gas chambers 91. The plurality of vibration damping regions 90 is a region reversibly deformable.

The diaphragm 3 with the vibration damping region 90 can reduce a pressure vibration. The pressure vibration is generated by a pressure wave generated in the pressure chamber 6 due to the liquid discharge and propagated to other pressure chambers 6 through the common-supply channel 10. Thus, the head 100 can stably discharge the liquid from the nozzles 4.

To reduce the pressure vibration propagating to the other pressure chambers 6 through the common-supply channel 10, the compliance of the vibration damping region 90 is on the order of $1E^{-15}$ to $1E^{-16}$ [$m^3$/Pa]. However, if a position of the compliance (position of the vibration damping region 90) becomes far from the pressure chamber 6, the damping effect is reduced.

Therefore, the head 100 according to the present embodiment includes the vibration damping region 90 (damper) arranged on an outlet side of the common-supply channel 10 (a side close to the intermediate-supply channel 8). Thus, the vibration damping region 90 can be formed at a position close to each of the pressure chambers 6 to effectively damp the pressure vibration.

In the above-described configuration, since a compliance of air in a sealed (closed) space (gas chamber 91) is smaller than a compliance of the vibration damping region 90 (damper) which is usually formed of the thin portion, the compliance of air becomes dominant. However, the compliance of the vibration damping region 90 (damper) is sufficient to reduce the pressure generated in the pressure chamber 6. Therefore, a sufficient vibration damping effect can be exhibited even in a sealed space in which the gas chamber 91 is sealed without an air vent. However, the gas chamber 91 may include the air vent to increase the vibration damping effect.

Further, the vibration damping region 90 can reduce the pressure vibration due to a rapid change in a flow rate caused by simultaneously discharging liquid from the plurality of nozzles 4.

To reduce the pressure vibration accompanying with the simultaneous discharge, a large compliance is needed. As the compliance, an order of about $1E^{-12}$ to $1E^{-14}$ [$m^3$/Pa] is required. However, influence of a position of the compliance (position of the vibration damping region 90) with respect to the common-supply channel 10 becomes small since the pressure vibration vibrates in entire common-supply channel 10.

Thus, the head 100 according to the present embodiment includes the gas chamber 91 at a position corresponding to the vibration damping region 90, and the gas chamber 91 communicates with outside the gas chamber 91. Thus, the head 100 can obtain a large compliance.

Thus, the head 100 includes the diaphragm 3 serving as a partition between the channel plate 2 and the common-channel member 20 (see FIGS. 2 and 3). The channel plate 2 is an individual-channel member that forms the pressure chamber 6 and the individual-supply channel 7 as an individual channel. the common-channel member 20 forms the common-supply channel 10 as a common channel.

The diaphragm 3 as a partition includes the openings 9 and the vibration damping region 90 arranged alternately in the nozzle array direction NAD as illustrated in FIG. 4. The openings 9 are through-hole regions that connect the common-supply channel 10 and the individual-supply channel 7 via the intermediate-supply channel 8. The vibration damping regions 90 face the common-supply channel 10 and are recoverably deformable.

Thus, the head 100 can reduce fluctuation of the discharge properties with a simple structure.

Figure 5:
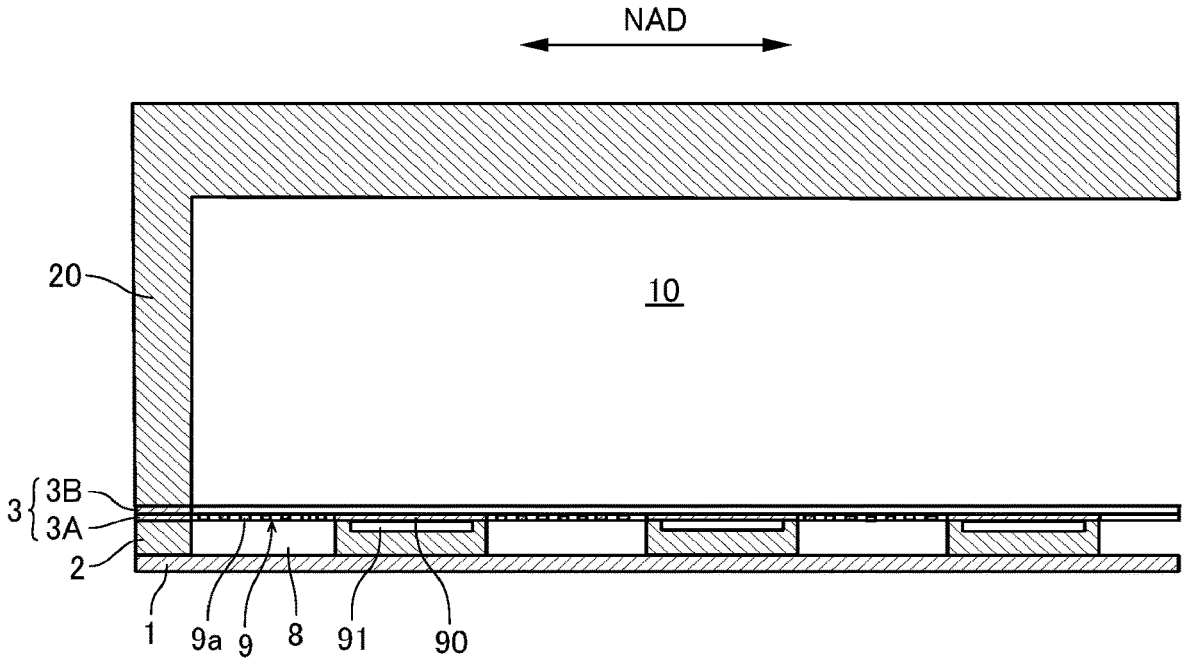
FIG. 5 is a cross-sectional view of the liquid discharge head according to a second embodiment of the present disclosure along the nozzle array direction corresponding to a line A1-A1 in FIGS. 1 and 2.
Figure 6:
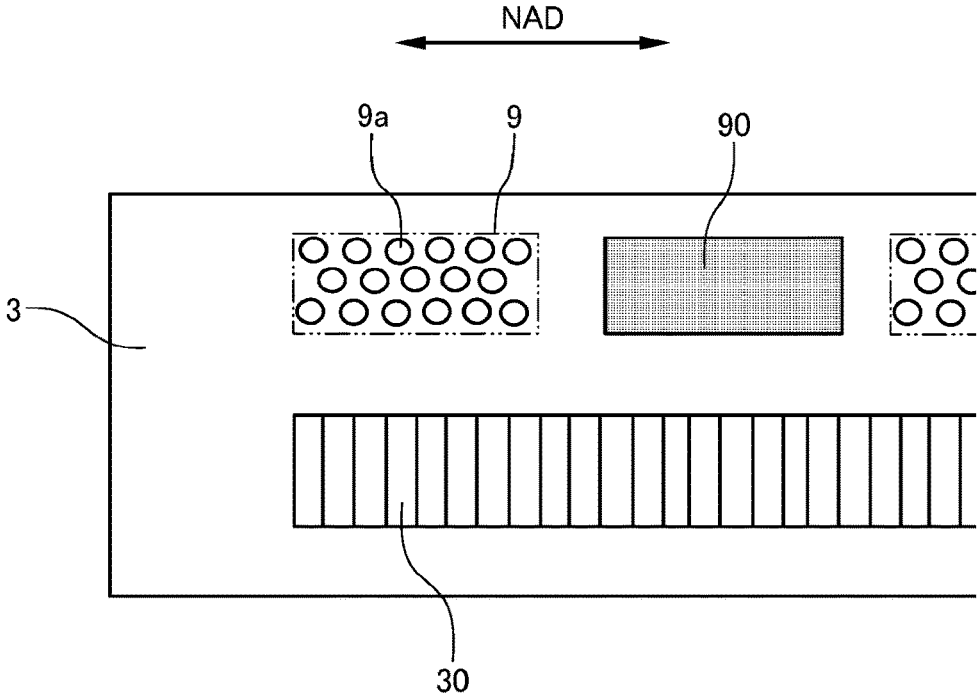
FIG. 6 is an enlarged plan view of a main part of a diaphragm.

A second embodiment of the present disclosure is described with reference to FIGS. 5 and 6. FIG. 5 is a cross-sectional view of the head 100 according to the second embodiment of the present disclosure along a direction perpendicular to a nozzle array direction NAD corresponding to a line A1-A1 in FIGS. 1 and 2. FIG. 6 is an enlarged plan view of the diaphragm 3 of the head 100 according to the second embodiment of the present disclosure.

In the present embodiment, the opening 9 serving as the through-hole region includes a filter including a plurality of through-holes 9*a* smaller than a diameter of the nozzle 4.

Thus, the head 100 can prevent foreign matter from flowing into the pressure chamber 6 and causing the nozzle 4 to be clogged.

Next, a third embodiment of the present disclosure is described with reference to FIGS. 7 to 12.

Figure 7:
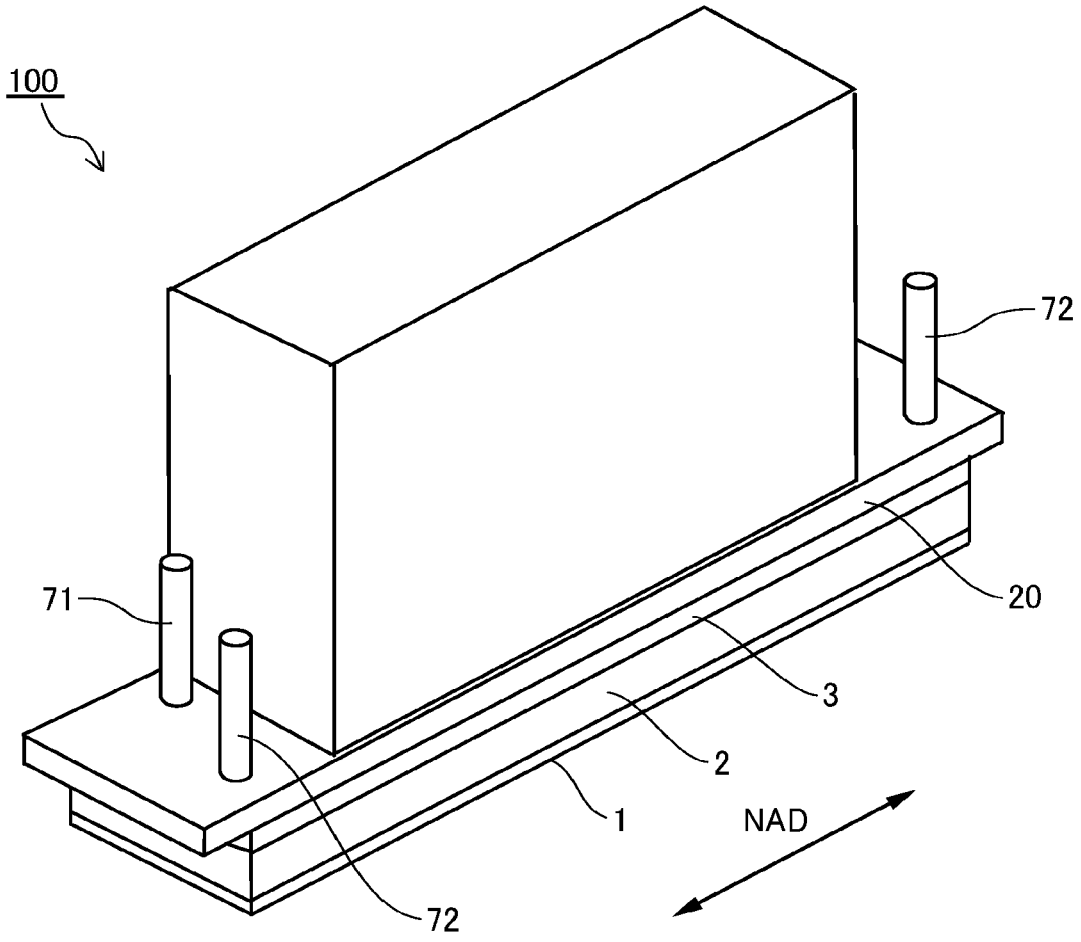
FIG. 7 is an external perspective view of the liquid discharge head according to a third embodiment of the present disclosure.

FIG. 7 is an external perspective view of the head 100 according to the third embodiment.

Figure 8:
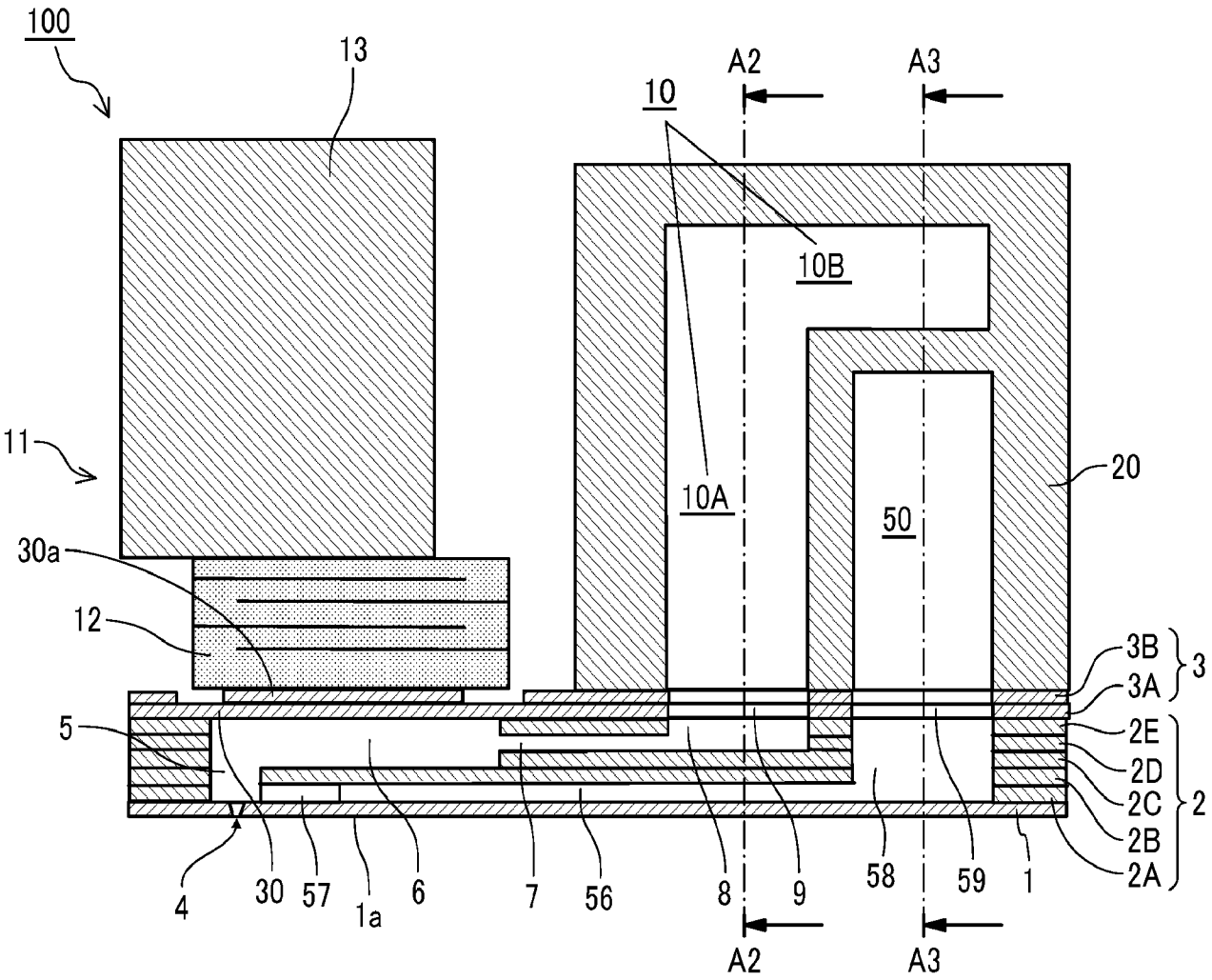
FIG. 8 is a cross-sectional view of the liquid discharge head along the direction perpendicular to the nozzle array direction corresponding to a line B2-B2 in FIGS. 10 and 11.
Figure 10:
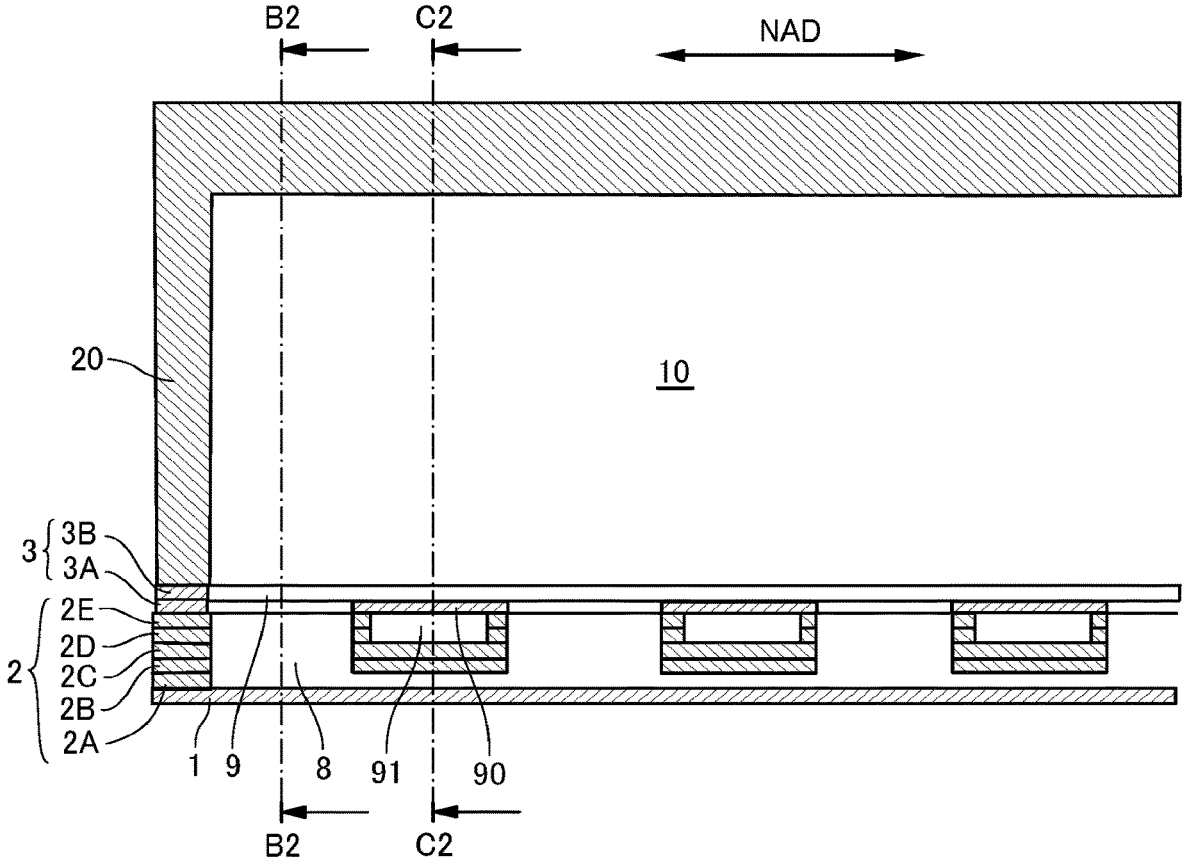
FIG. 10 is a cross-sectional view of the liquid discharge head along the nozzle array direction corresponding to a line A2-A2 in FIGS. 8 and 9.
Figure 11:
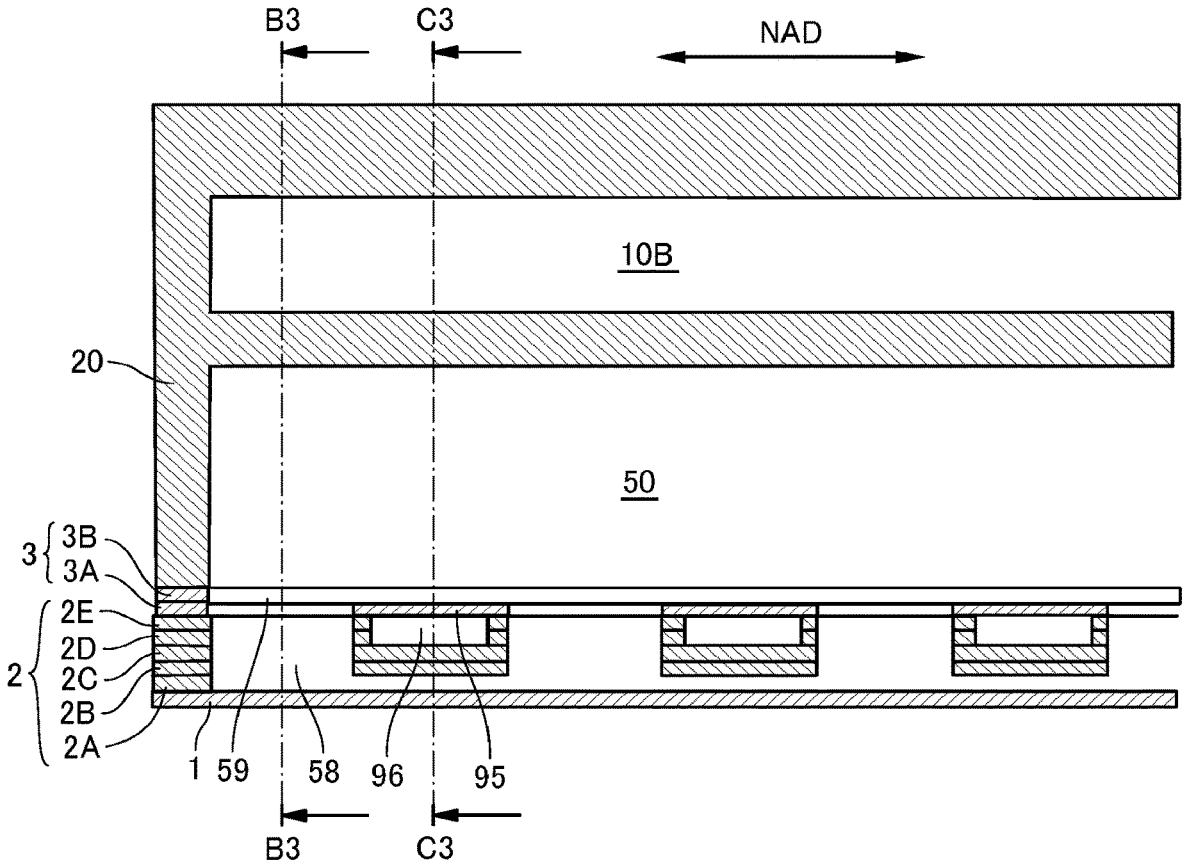
FIG. 11 is a cross-sectional view along the nozzle array direction corresponding to a line A3-A3 in FIGS. 8 and 9.

FIG. 8 is a cross-sectional view of the head 100 along the direction perpendicular to the nozzle array direction NAD corresponding to a line B2-B2 in FIGS. 10 and 11.

Figure 9:
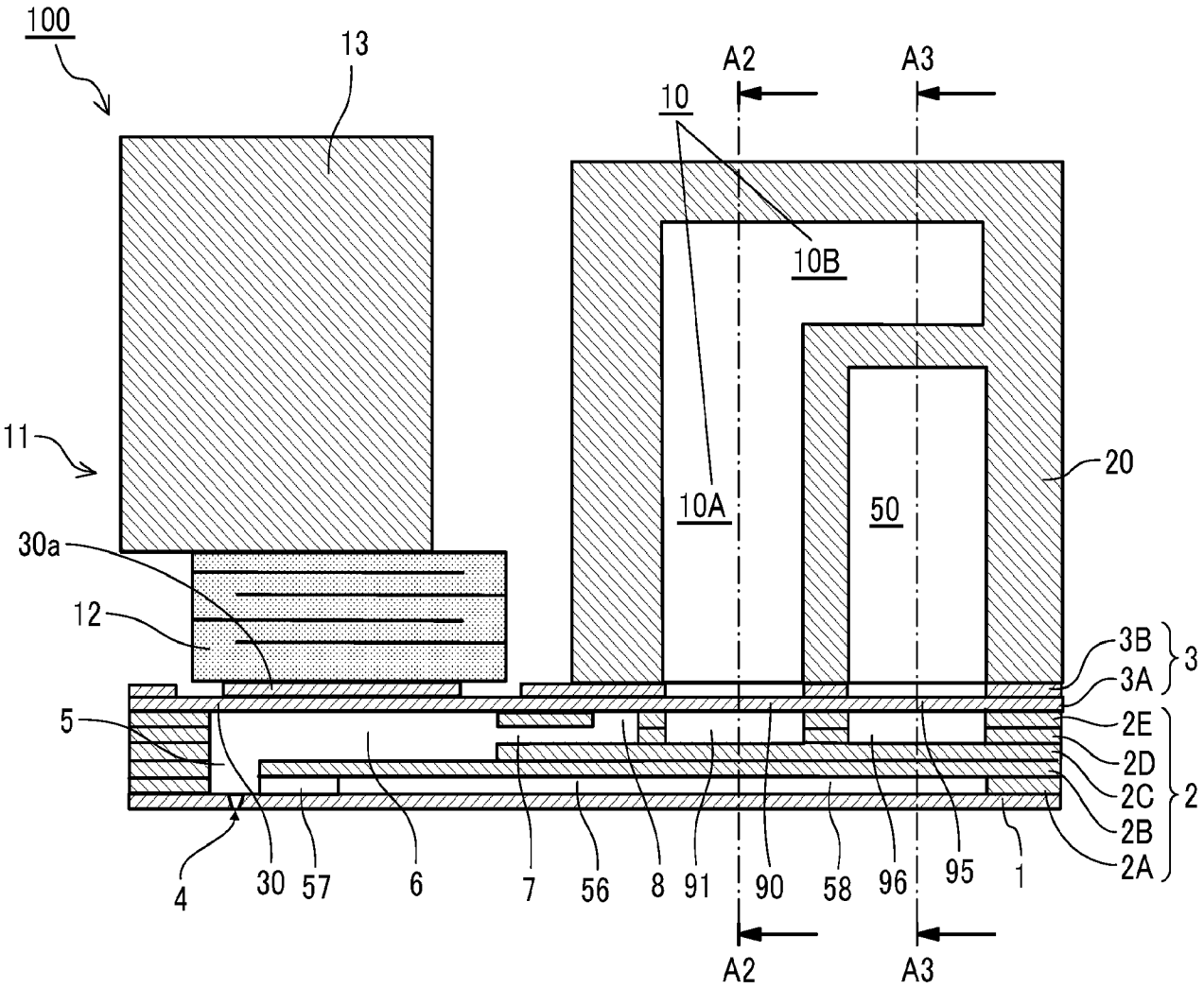
FIG. 9 is a cross-sectional view of the liquid discharge head along the direction perpendicular to the nozzle array direction corresponding to a line C2-C2 in FIGS. 10 and 11.

FIG. 9 is a cross-sectional view of the head 100 along the direction perpendicular to the nozzle array direction NAD corresponding to a line C2-C2 in FIGS. 10 and 11.

FIG. 10 is a cross-sectional view of the head 100 along the nozzle array direction NAD corresponding to a line A2-A2 in FIGS. 8 and 9.

FIG. 11 is a cross-sectional view along the nozzle array direction NAD corresponding to a line A3-A3 in FIGS. 8 and 9.

Figure 12:
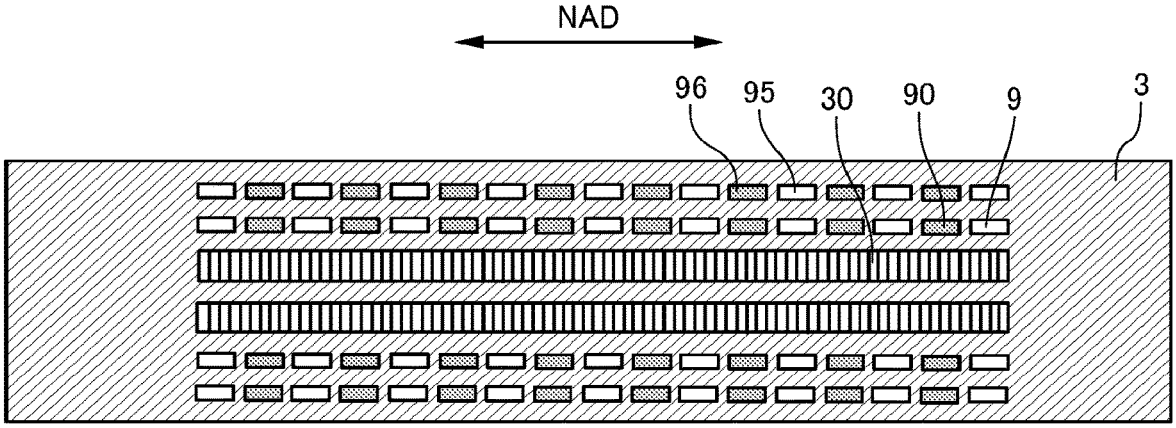
FIG. 12 is a plan view of a diaphragm of the liquid discharge head according to the third embodiment of the present disclosure.

FIG. 12 is a plan view of a diaphragm 3 of the head 100 according to the third embodiment.

The head 100 according to the present embodiment is a circulation-type liquid discharge head. The head 100 includes a nozzle plate 1, a channel plate 2, and a diaphragm 3 as a wall member laminated and bonded with each other. The head 100 further includes a piezoelectric actuator 11 to displace vibration portions 30 of the diaphragm 3 and a common-channel member 20 also serving as a frame of the head 100.

The channel plate 2 includes a plurality of pressure chambers 6, individual-supply channels 7, and an intermediate-supply channel 8, for example. The pressure chambers 6 respectively communicate with the plurality of nozzles 4 via the nozzle communication channels 5. The individual-supply channels 7 also serve as a plurality of fluid restrictors respectively communicating with the plurality of pressure chambers 6. The intermediate-supply channel 8 serves as one or more liquid introduction portions communicating with two or more individual-supply channels 7.

The channel plate 2 includes a lamination of a plurality of plates 2A to 2E. However, the channel plate 2 according to the present embodiment is not limited to the embodiments as described above.

Further, the channel plate 2 includes a plurality of individual-collection channels 56 an intermediate-collection channel 58. The plurality of individual-collection channels 56 includes fluid restrictors 57 along a surface direction of the channel plate 2. The plurality of individual-collection channels 56 respectively communicates with the plurality of pressure chambers 6 via the nozzle communication channels 5. The intermediate-collection channel 58 serves as one or more liquid outlets communicating with two or more of the individual-collection channels 56.

The common-channel member 20 forms a common-supply channel 10 and a common-collection channel 50 (common-collection channel). In the present embodiment, the common-supply channel 10 includes a channel portion 10A arranged side-by-side with the common-collection channel 50 in the nozzle array direction NAD and a channel portion 10B that is not arranged side-by-side with the common-collection channel 50.

The common-supply channel 10 communicates with the intermediate-supply channel 8 serving as the liquid inlets through the opening 9 formed in the diaphragm 3 and further communicates with the individual-supply channel 7 through the intermediate-supply channel 8. The common-collection channel 50 communicates with the intermediate-collection channel 58 serving as the liquid outlet through an opening 59 formed in the diaphragm 3 and further communicates with the individual-collection channel 56 through the intermediate-collection channel 58.

Further, the common-supply channel 10 communicates with the supply port 71, and the common-collection channel 50 communicates with the collection port 72.

The other configurations such as layer configuration of the diaphragm 3 and the configuration of the piezoelectric actuator 11 are the same as the configurations as described in the first embodiment.

In the head 100 according to the third embodiment as well, as similarity with the first embodiment, when the voltage applied to the piezoelectric element 12 is raised, the piezoelectric element 12 expands in a direction of lamination of the piezoelectric element 12. The vibration portion 30 of the diaphragm 3 deforms in a direction toward the nozzle 4 and contracts the volume of the pressure chambers 6. As a result, the liquid in the pressure chambers 6 is squeezed out of the nozzle 4.

The liquid not discharged from the nozzles 4 passes the nozzles 4, and is delivered from individual-collection channel 56 to common-collection channel 50 and is supplied to the common-supply channel 10 again through an external circulation channel from the common-collection channel 50.

Next, the configuration of dampers in the present embodiment is described below with reference to FIGS. 3 and 4.

The diaphragm 3 as a partition is arranged between the channel plate 2 and the common-channel member 20. The channel plate 2 is an individual-channel member that forms the pressure chamber 6, the individual-supply channel 7, and the individual-collection channel 56. The common-channel member 20 defines the common-supply channel 10 and the common-collection channel 50.

The diaphragm 3 as a partition includes the openings 9 and the vibration damping region 90 arranged alternately in the nozzle array direction NAD as illustrated in FIGS. 9 to 12. The openings 9 are the through-hole regions. The vibration damping regions 90 face the common-supply channel 10 and are recoverably deformable.

Further, the diaphragm 3 as a partition includes the openings 59 and the vibration damping region 95 arranged alternately in the nozzle array direction NAD as illustrated in FIGS. 9 to 12. The openings 59 are the through-hole regions. The vibration damping regions 95 face the common-collection channel 50 and are recoverably deformable.

The opening 9 communicates the common-supply channel 10 and the intermediate-supply channel 8 that communicates with the individual-supply channel 7. In the present embodiment, the opening 9 is formed by one through hole. The vibration damping region 90 is formed by the first layer 3A that is a thin portion of the diaphragm 3.

Further, the channel plate 2 includes a gas chamber 91 formed on a surface of the channel plate 2 facing (corresponding to) the vibration damping region 90. Specifically, the gas chamber 91 of the channel plate 2 faces a surface of the vibration damping region 90 of the diaphragm 3 opposite to a surface of the diaphragm 3 facing the common-supply channel 10. In the present embodiment, the gas chamber 91 is formed by through holes formed in the plates 2D and 2E constituting the channel plate 2.

The plates 2B and 2C of the channel plate 2 closes (seals) a space in the gas chamber 91 formed by through holes formed in the plates 2D and 2E constituting the channel plate 2. Thus, as illustrated in FIG. 10, the gas chamber 91 is formed by the first layer 3A of the diaphragm 3 that closes a top surface of the gas chamber 91, the plates 2D and 2D of the channel plate 2 forming the space of the gas chamber 91, and the plates 2B and 2C that closes a bottom surface of the gas chamber 91.

The opening 59 connects the common-collection channel 50 and the intermediate-collection channel 58 that communicates with the individual-collection channel 56. In the present embodiment, the opening 59 is constituted by one through hole. The vibration damping regions 95 are formed by the first layer 3A that is a thin portion of the diaphragm 3.

Further, the channel plate 2 includes a gas chamber 96 formed on a surface of the channel plate 2 facing (corresponding to) the vibration damping region 95. Specifically, the gas chamber 96 of the channel plate 2 faces a surface of the vibration damping region 95 of the diaphragm 3 opposite to a surface of the diaphragm 3 facing the common-collection channel 50. In the present embodiment, the gas chamber 96 is formed by through holes formed in the plates 2D and 2E constituting the channel plate 2.

The plates 2B and 2C of the channel plate 2 closes (seals) a space in the gas chamber 96 formed by through holes formed in the plates 2D and 2E constituting the channel plate 2. Thus, as illustrated in FIG. 11, the gas chamber 96 is formed by the first layer 3A of the diaphragm 3 that closes a top surface of the gas chamber 96, the plates 2D and 2D of the channel plate 2 forming the space of the gas chamber 96, and the plates 2B and 2C that closes a bottom surface of the gas chamber 96.

The diaphragm 3 with the vibration damping region 90 can reduce the pressure vibration. The pressure vibration is generated by a pressure wave generated in the pressure chamber 6 due to the liquid discharge and propagated to other pressure chambers 6 through the common-supply channel 10. Thus, the head 100 can stably discharge the liquid from the nozzles 4. The diaphragm 3 with the vibration damping region 95 can reduce the pressure vibration. The pressure vibration is generated by a pressure wave generated in the pressure chamber 6 due to the liquid discharge and propagated to other pressure chambers 6 through the common-collection channel 50. Thus, the head 100 can stably discharge the liquid from the nozzles 4.

Further, the head 100 with the vibration damping region 90 and the gas chamber 91 can obtain a large compliance. Thus, the head 100 can reduce the pressure vibration in the common-supply channel 10 due to a rapid change in flow rate caused by simultaneously discharging liquid from the plurality of nozzles 4. Thus, the head 100 according to the present embodiment includes the vibration damping region 95 and the gas chamber 96, and thus can obtain a large compliance. Thus, the head 100 can reduce the pressure vibration in the common-collection channel 50 due to a rapid change in flow rate caused by simultaneously discharging liquid from the plurality of nozzles 4.

Figure 13:
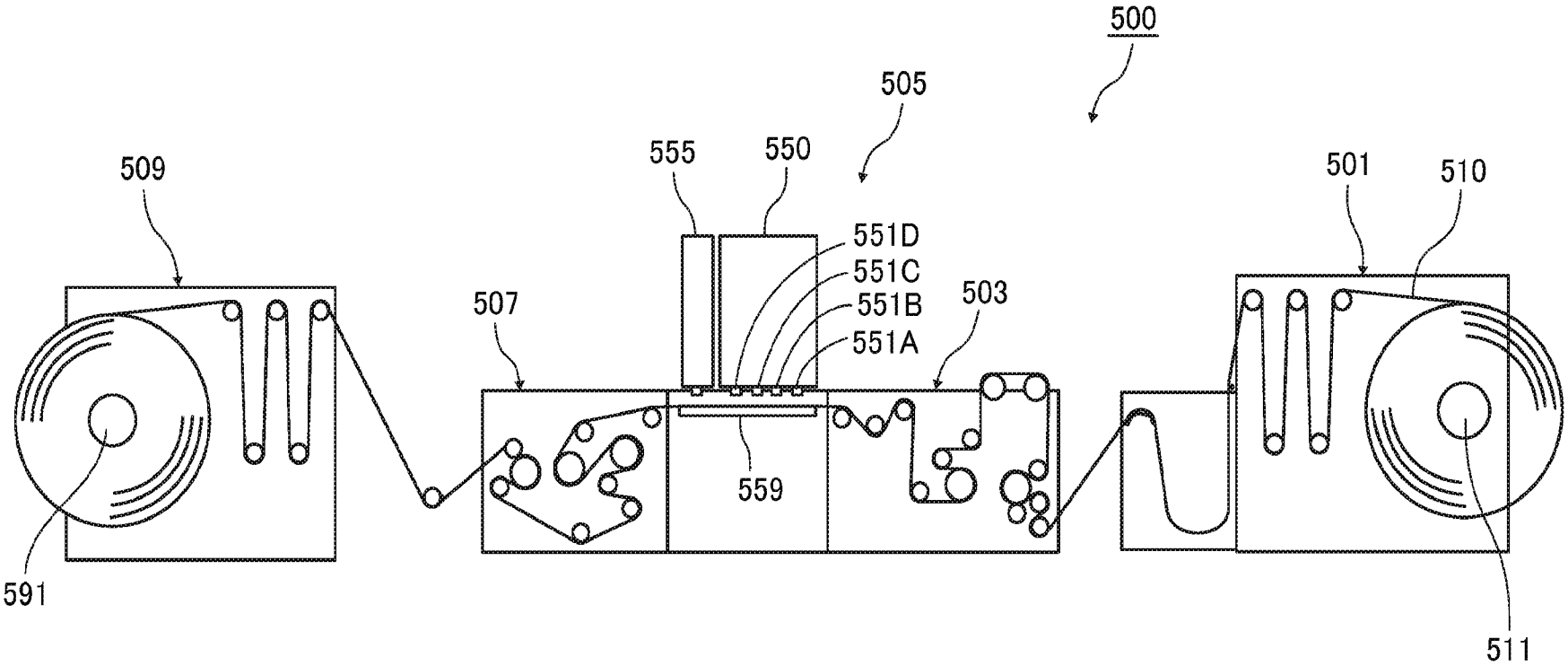
FIG. 13 is a schematic side view of a liquid discharge apparatus according to the present embodiment.
Figure 14:
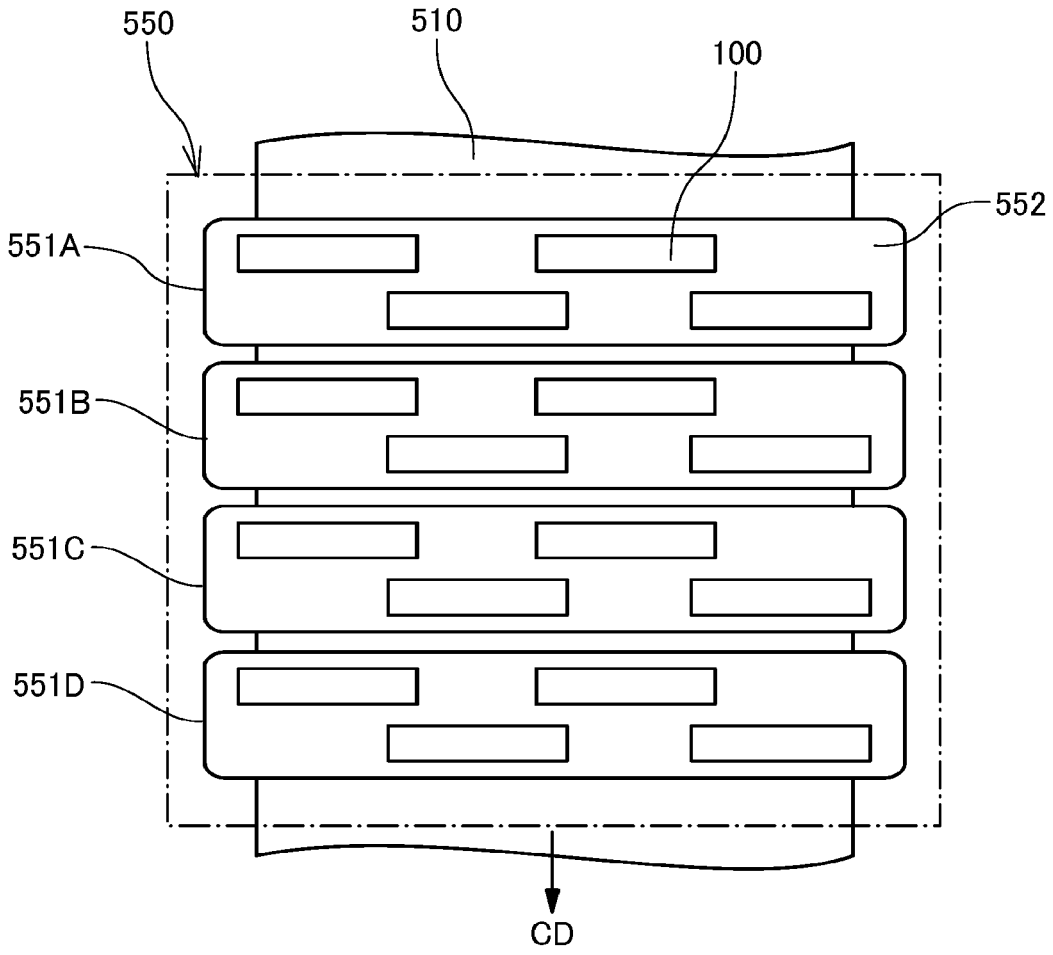
FIG. 14 is a plan view of an example of a head unit of the liquid discharge apparatus of FIG. 13.

FIGS. 13 and 14 illustrate an example of a liquid discharge apparatus according to an embodiment of the present disclosure. FIG. 13 is a side view of a liquid discharge apparatus according to an embodiment of the present disclosure. FIG. 14 is a plan view of a head unit of the liquid discharge apparatus of FIG. 13 according to the present embodiment.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge a liquid onto the continuous medium 510 to form an image on the continuous medium 510, a dryer 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the dryer 507, and the ejector 509, and wound around a take-up roller 591 of the ejector 509.

In the printing unit 505, the continuous medium 510 is conveyed opposite a first head unit 550 and a second head unit 555 on a conveyance guide 559. The first head unit 550 discharges liquid to form an image on the continuous medium 510. Post-treatment is performed on the continuous medium 510 with treatment liquid discharged from the second head unit 555.

Here, the first head unit 550 includes, for example, four color full-line head arrays 551A, 551B, 551C, and 551D from the upstream side in a conveyance direction of the continuous medium 510 indicated by arrow "CD" in FIG. 14. Hereinafter, the full-line head arrays 551A, 551B, 551C, and 551D are simply referred to as "head array 551" when colors are not distinguished.

Each of the head arrays 551 is a liquid discharge device to discharge liquid of black (K), cyan (C), magenta (M), and yellow (Y) onto the continuous medium 510 conveyed along the conveyance direction CD of the continuous medium 510. Note that the number and types of color are not limited to the above-described four colors of K, C, M, and Y and may be any other suitable number and types.

In each head arrays 551, for example, as illustrated in FIG. 14, the heads 100 according to the present embodiment are staggered on a base 552 to form the head array 551. Note that the configuration of the head array 551 is not limited to such a configuration.

Figure 15:
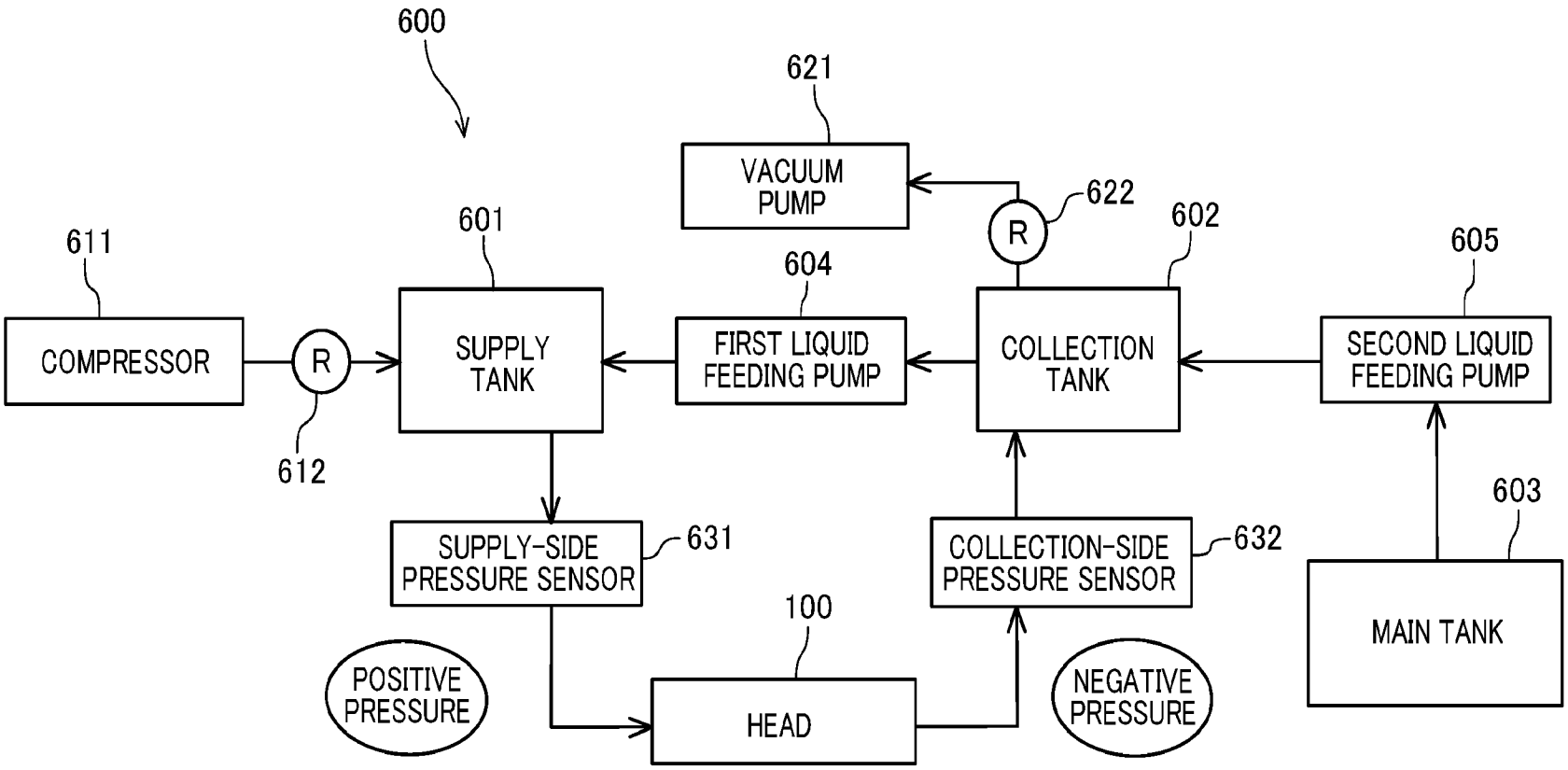
FIG. 15 is a circuit diagram illustrating an example of a liquid circulation device according to the present embodiment.

FIG. 15 illustrates an example of a liquid circulation device 600 employed in the printer 500 according to the present embodiment.

The liquid circulation device 600 configures a supply unit according to the present embodiment.

FIG. 15 is a circuit diagram illustrating a structure of the liquid circulation device 600. Although only one head 100 is illustrated in FIG. 15, in the structure including a plurality of heads 100 as illustrated in FIG. 14, supply channels and collection channels are respectively coupled via manifolds or the like to the supply sides and collection sides of the plurality of heads 100.

The liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, and a supply-side pressure sensor 631, and a collection-side pressure sensor 632.

The compressor 611 and the vacuum pump 621 together generate a difference of pressure between the pressure in the supply tank 601 and the pressure in the collection tank 602.

The supply-side pressure sensor 631 is connected between the supply tank 601 and the head 100 and connected to the supply channels connected to the supply port 71 of the head 100. The collection-side pressure sensor 632 is connected between the head 100 and the collection tank 602 and is connected to the collection channels connected to the collection port 72 of the head 100.

One end of the collection tanks 602 is connected to the supply tank 601 via the first liquid feed pump 604, and another end of the collection tanks 602 is connected to the main tank 603 via the second liquid feed pump 605.

Accordingly, the liquid flows from the supply tank 601 into the head 100 via the supply port 71 and exits the head 100 from the collection port 72 into the collection tank 602. Further, the first liquid feed pump 604 feeds the liquid from the collection tank 602 to the supply tank 601. Thus, the liquid circulation channel is constructed.

Here, a compressor 611 is connected to the supply tank 601 and is controlled so that a predetermined positive pressure is detected by the supply-side pressure sensor 631. Conversely, a vacuum pump 621 is connected to the collection tank 602 and is controlled so that a predetermined negative pressure is detected by the collection-side pressure sensor 632.

Such a configuration allows the menisci of ink to be maintained at a constant negative pressure while circulating liquid through the inside of the head 100.

When droplets are discharged from the nozzles 4 of the head 100, the amount of liquid in each of the supply tank 601 and the collection tank 602 decreases. Therefore, the liquid is replenished from the main tank 603 to the collection tank 602 using the second liquid feed pump 605 as appropriate.

The timing of supply of liquid from the main tank 603 to the collection tank 602 can be controlled in accordance with a result of detection by a liquid level sensor in the collection tank 602. For example, the liquid is supplied to the collection tank 602 from the main tank 603 when the liquid level in the collection tank 602 becomes lower than a predetermined height.

Figure 16:
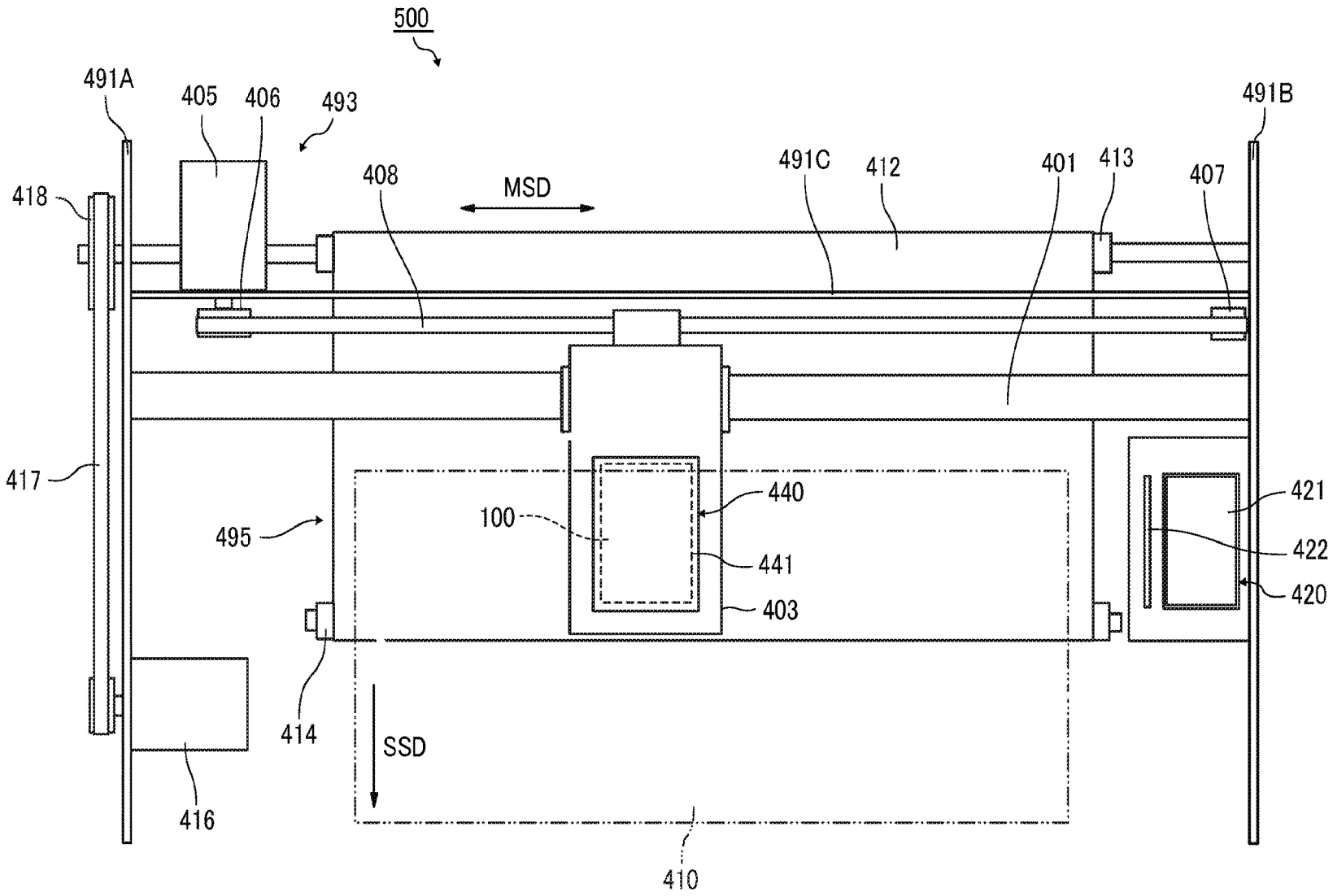
FIG. 16 is a plan view of a portion of a liquid discharge apparatus according to another example of the present embodiment.
Figure 17:
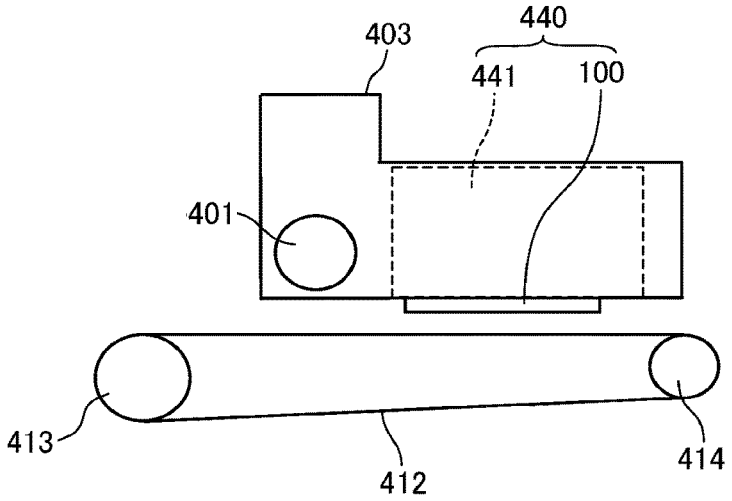
FIG. 17 is a schematic side view of a main portion of the liquid discharge apparatus.

Next, another example of a printer 500 serving as a liquid discharge apparatus according to the present embodiment is described with reference to FIGS. 16 and 17. FIG. 16 is a plan view of a portion of the printer 500. FIG. 17 is a side view of a portion of the printer 500 of FIG. 16.

The printer 500 is a serial type apparatus, and the carriage 403 is reciprocally moved in the main scanning direction indicated by arrow "MSD" by the main scan moving unit 493. The main scan moving unit 493 includes a guide 401, a main scanning motor 405, and a timing belt 408. The guide 401 is bridged between a left-side plate 491A and a right-side plate 491B to moveably hold the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 100 according to the present embodiment and a head tank 441 forms the liquid discharge device 440 as a single unit. The head tank 441 stores the liquid to be supplied to the head 100.

The head 100 of the liquid discharge device 440 discharges liquid of each color, for example, yellow (Y), cyan (C), magenta (M), and black (K). The head 100 includes a nozzle array including the plurality of nozzles 4 arrayed in row in a sub-scanning direction indicated by arrow "SSD" perpendicular to the main scanning direction MSD indicated by arrow MSD in FIG. 16. The head 100 is mounted to the carriage 403 so that ink droplets are discharged downward.

The head 100 is connected to the liquid circulation device 600 described above, and a liquid of a required color is circulated and supplied.

The printer 500 includes a conveyor 495 to convey a sheet 410. The conveyor 495 includes a conveyance belt 412 as a conveyor and a sub-scanning motor 416 to drive the conveyance belt 412.

The conveyance belt 412 attracts the sheet 410 and conveys the sheet 410 at a position facing the head 100. The conveyance belt 412 is an endless belt and is stretched between a conveyance roller 413 and a tension roller 414. The sheet 410 can be attracted to the conveyance belt 412 by electrostatic attraction, air suction, or the like.

The conveyance belt 412 cyclically rotates in the sub-scanning direction SSD as the conveyance roller 413 is rotationally driven by the sub-scanning motor 416 via the timing belt 417 and the timing pulley 418.

At one side in the main scanning direction MSD of the carriage 403, a maintenance unit 420 to maintain the head 100 in good condition is disposed on a lateral side of the conveyance belt 412.

The maintenance unit 420 includes, for example, a cap 421 to cap a nozzle surface 1*a* (see FIG. 8) of the head 100, a wiper 422 to wipe the nozzle surface 1*a*, and the like. The nozzle surface 1*a* is a surface on which the nozzle 4 is formed.

The main scan moving unit 493, the maintenance unit 420, and the conveyor 495 are mounted to a housing that includes a left-side plate 491A, a right-side plate 491B, and a rear-side plate 491C.

In the printer 500 thus configured, the sheet 410 is conveyed on and attracted to the conveyance belt 412 and is conveyed in the sub-scanning direction SSD by the cyclic rotation of the conveyance belt 412.

The head 100 is driven in response to image signals while the carriage 403 moves in the main scanning direction MSD, to discharge liquid to the sheet 410 stopped, thus forming an image on the sheet 410.

Figure 18:
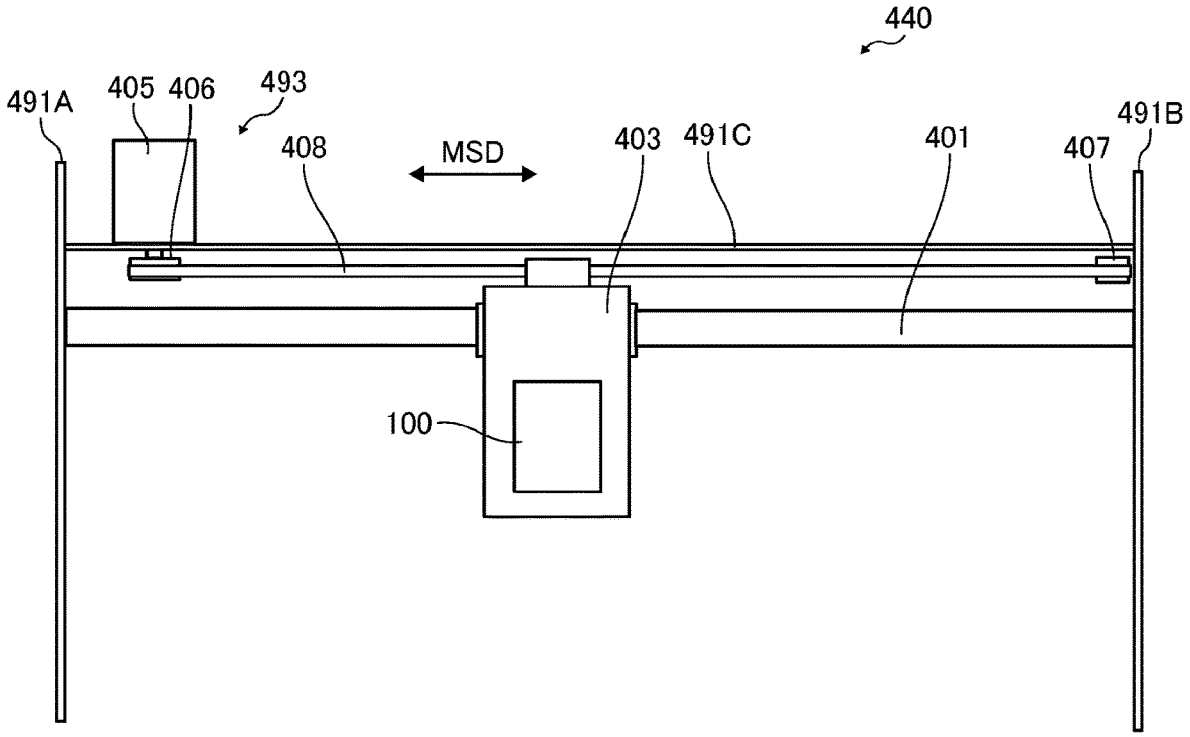
FIG. 18 is a plan view of a portion of another example of a liquid discharge device.

Next, the liquid discharge device 440 according to another embodiment of the present embodiment is described with reference to FIG. 18. FIG. 18 is a plan view of a portion of another example of the liquid discharge device 440.

The liquid discharge device 440 includes a housing, the main scan moving unit 493, the carriage 403, and the head 100 among components of the printer 500. The left-side plate 491A, the right-side plate 491B, and the rear-side plate 491C constitute the housing.

Note that, in the liquid discharge device 440, the maintenance unit 420 described above may be mounted on, for example, the right-side plate 491B.

Figure 19:
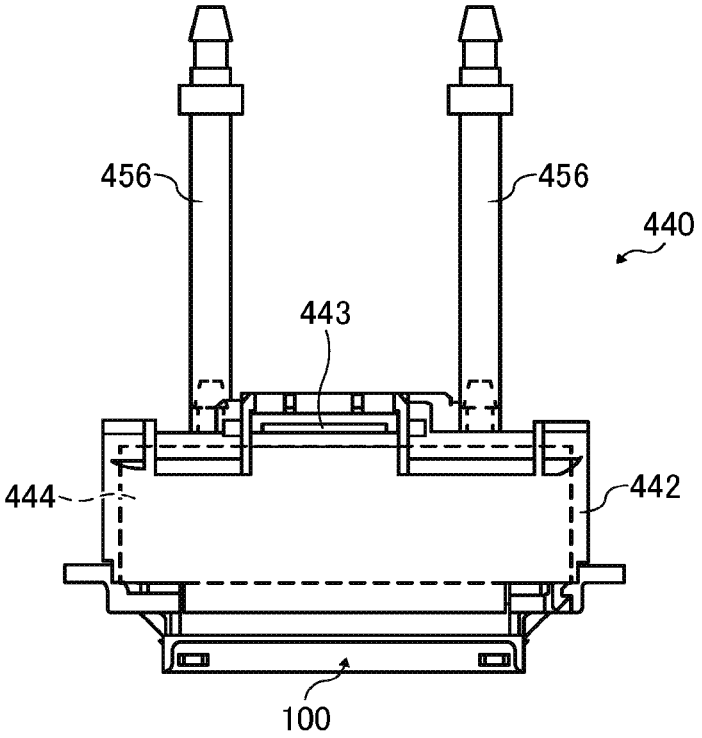
FIG. 19 is a front view of the liquid discharge device according to still another embodiment of the present disclosure.

Next, still another example of the liquid discharge device 440 according to the present embodiment is described with reference to FIG. 19. FIG. 19 is a front view of still another example of the liquid discharge device 440.

The liquid discharge device 440 includes the head 100 to which a channel part 444 is attached, and a tube 456 connected to the channel part 444.

Further, the channel part 444 is disposed inside a cover 442. Instead of the channel part 444, the liquid discharge device 440 may include the head tank 441. A connector 443 electrically connected with the head 100 is provided on an upper part of the channel part 444.

In the present disclosure, discharged liquid is not limited to a particular liquid as long as the liquid has a viscosity or surface tension to be discharged from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the head to which the head tank or the channel member is attached so that the head and a supply unit form a single unit. Liquid is supplied from a liquid reservoir source to the head via the tube.

The main scan moving unit may be a guide only. The supply unit may be a tube(s) only or a loading unit only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media such as a paper sheet, recording paper, and a recording sheet of paper, film, and cloth, electronic components such as an electronic substrate and a piezoelectric element, and media such as a powder layer, an organ model, and a testing cell. The "material on which liquid can be adhered" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles through which a liquid is discharged, the plurality of nozzles arrayed in a nozzle array direction;

a plurality of pressure chambers respectively communicating with the plurality of nozzles;

a plurality of individual channels respectively communicating with the plurality of pressure chambers;

a common channel communicating with each of the plurality of individual channels;

an individual-channel member including the plurality of pressure chambers and the plurality of individual channels;

a common-channel member including the common channel; and a partition between the individual-channel member and the common-channel member, wherein the partition includes:

a plurality of through-hole regions each connecting the common channel and the plurality of individual channels; and a plurality of recoverably-deformable regions facing the common channel.

2. The liquid discharge head according to claim 1, the plurality of through-hole regions and the plurality of recoverably-deformable regions are alternately arranged in the nozzle array direction.

3. The liquid discharge head according to claim 1, wherein the plurality of individual channels respectively includes a plurality of individual-supply channels respectively communicating with the plurality of pressure chambers, and the common channel includes a common-supply channel communicating with each of the plurality of individual-supply channels.

4. The liquid discharge head according to claim 1, wherein the plurality of individual channels respectively includes a plurality of individual-collection channels respectively communicating with the plurality of pressure chambers, and the common channel includes a common-collection channel communicating with each of the plurality of individual-collection channels.

5. The liquid discharge head according to claim 1, wherein the plurality of individual channels includes:

a plurality of individual-supply channels respectively communicating with the plurality of pressure chambers; and a plurality of individual-collection channels respectively communicating with the plurality of pressure chambers, and the common channel includes:

a common-supply channel communicating with each of the plurality of individual-supply channels; and a common-collection channel communicating with each of the plurality of individual-collection channels.

6. The liquid discharge head according to claim 1, wherein the individual-channel member includes a plurality of gas chambers at positions corresponding to the plurality of recoverably-deformable regions.

7. The liquid discharge head according to claim 6,
wherein a compliance of each of the plurality of recoverably-deformable regions is larger than a compliance of each of the plurality of gas chambers.

8. The liquid discharge head according to claim 6,
wherein the individual-channel member includes a lamination of a plurality of plates,
the plurality of plates includes:
a first plate in which the plurality of gas chambers is formed, and
a second plate closing a space in each of the plurality of gas chambers.

9. The liquid discharge head according to claim 8,
wherein the partition includes a thin portion and a thick portion thicker than the thin portion, and
each of the plurality of recoverably-deformable regions is formed by the thin portion of the partition.

10. The liquid discharge head according to claim 9,
wherein the thin portion closes the space in each of the plurality of gas chambers with the second plate.

11. The liquid discharge head according to claim 1,
wherein the partition is formed of a plurality of materials having different rigidities, and
each of the plurality of recoverably-deformable regions is formed of a material having a lower rigidity than another material among the plurality of materials.

12. The liquid discharge head according to claim 1,
wherein the partition includes a diaphragm forming a wall of each of the plurality of pressure chambers.

13. The liquid discharge head according to claim 1,
wherein each of the plurality of recoverably-deformable regions of the partition has a length in the nozzle array direction and a width in a direction perpendicular to the nozzle array direction, and the length is larger than the width.

14. The liquid discharge head according to claim 1,
wherein the plurality of through-hole regions includes a filter including a plurality of through-holes,
a diameter of each of the plurality of through-holes is smaller than a diameter of each of the plurality of nozzles.

15. A liquid discharge device comprising the liquid discharge head according to claim 1.

16. The liquid discharge device according to claim 15,
wherein the liquid discharge head is formed together with at least one of:
a head tank configured to store the liquid to be supplied to the liquid discharge head,
a carriage on which the liquid discharge head is mounted,
a supply unit configured to supply the liquid to the liquid discharge head,
a maintenance unit configured to maintain the liquid discharge head, and
a main scan moving unit configured to move the liquid discharge head in a main scanning direction,
to form a single unit to form the liquid discharge device.

17. A liquid discharge apparatus comprising the liquid discharge device according to claim 15.

* * * * *